United States Patent [19]

Lehmann, deceased et al.

[11] 4,105,138

[45] Aug. 8, 1978

[54] APPARATUS FOR PRESETTING VOLUMES OF LIQUID

[75] Inventors: Karl-Otto Lehmann, deceased, late of Baden-Baden, Germany, by Gertrude Lehmann, heiress; Dieter Krause, Baden-Baden, Germany

[73] Assignee: Apparatebau Hundsbach Prof. Dr.-Ing. Habil., Dr. Phil. Nat. Karl-Otto Lehmann, Nachf., GmbH, Cie., Baden-Baden, Fed. Rep. of Germany

[21] Appl. No.: 773,656

[22] Filed: Mar. 2, 1977

[30] Foreign Application Priority Data

Mar. 4, 1976 [DE] Fed. Rep. of Germany ..... 2608995

[51] Int. Cl.[2] ..... B67D 5/30

[52] U.S. Cl. ..... 222/14; 222/23; 194/13; 235/92 FL

[58] Field of Search ..... 222/14–22, 222/23; 194/13, 3; 235/92 FL

[56] References Cited

U.S. PATENT DOCUMENTS

| | | | |
|---|---|---|---|
| 3,365,045 | 1/1968 | Guttmann et al. | 194/13 |
| 3,731,777 | 5/1973 | Burke et al. | 194/13 |
| 3,737,017 | 6/1973 | Burnoue | 194/13 |
| 3,777,935 | 12/1973 | Storey | 222/16 |
| 3,847,302 | 11/1974 | Krone et al. | 222/14 |
| 3,935,435 | 1/1976 | Greenwood | 194/13 X |
| 3,982,664 | 9/1976 | Robbins et al. | 222/21 |
| 3,985,266 | 10/1976 | Wright | 222/22 |

*Primary Examiner*—Robert B. Reeves
*Assistant Examiner*—Joseph J. Rolla
*Attorney, Agent, or Firm*—Kenyon & Kenyon, Reilly, Carr & Chapin

[57] ABSTRACT

An apparatus to provide control signals to a line containing a regulating valve for metering predetermined amounts of liquid in which the output of a flow meter is converted to a frequency, the frequency counted in two counters, one of which has been preset with a lead, and the outputs of the counters compared in comparators with a predetermined desired liquid volume, the comparator outputs being used respectively to reduce the flow and then eventually terminate the flow, the reduction and final termination giving a fine metering at the end of the cycle of operation.

7 Claims, 1 Drawing Figure

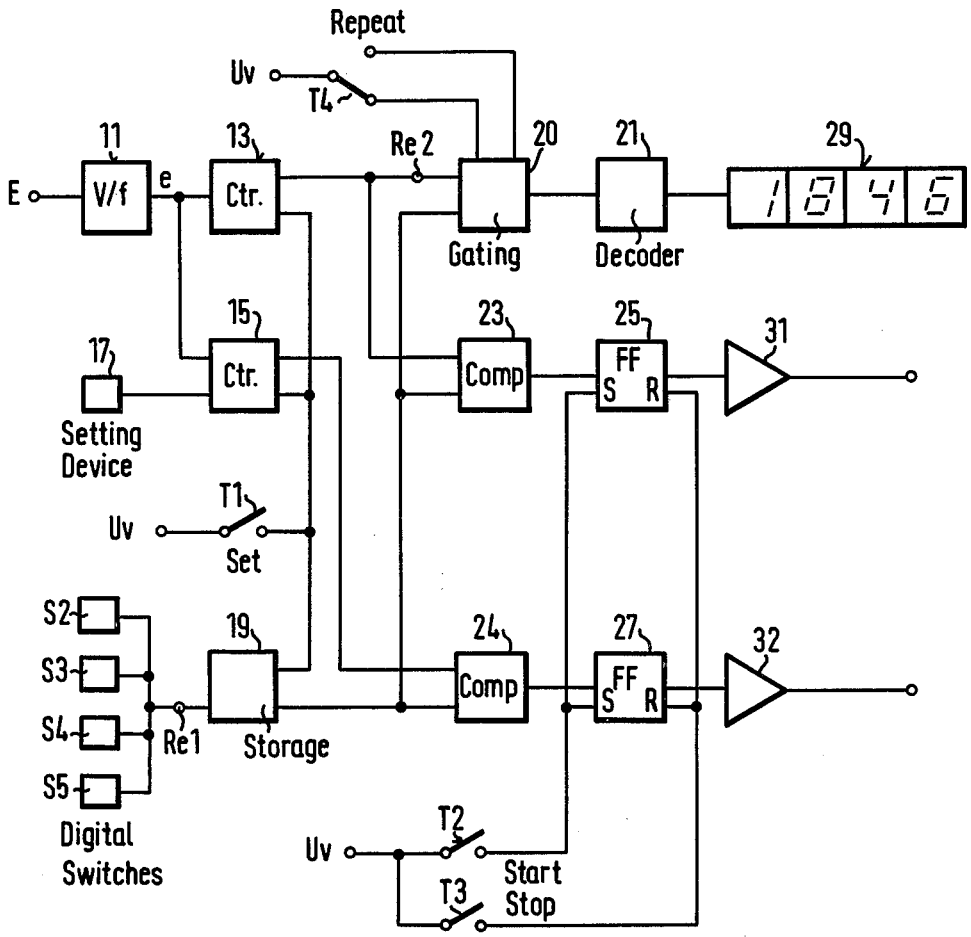
Repeat
Uv
T4
11
13
Re 2
20
21
29
E
V/f
e
Ctr.
Gating
Decoder
1 8 4 6
15
23
25
31
17
Ctr.
Comp
FF
S R
Setting
Device
T1
Uv
Set
S2
S3
S4
S5
19
24
27
32
Comp
FF
S R
Re 1
Storage
Digital
Switches
T2
Uv
Start
T3
Stop

APPARATUS FOR PRESETTING VOLUMES OF LIQUID

BACKGROUND OF THE INVENTION

This invention relates to the metering of volumes of liquid in general and more particularly to an improved control system for carrying out such metering.

Metering systems are known in which a counter which is driven by flow proportional signals is used to obtain an actual value of the flow which has taken place. Such devices use the counter output to compare with a set desired value and to terminate flow when the counter reaches the preset desired value. Such devices in which a lead value in order to obtain coarse and fine metering for driving a control element which reduces flow and for also driving a control element to stop flow are also known. Apparatus of this type is described in the journal ATM J122-7.

A problem with this known apparatus is that the magnitude of electrical voltages and currents required for its operation do not permit its use in an environment where there is an explosion hazard. Thus, there is need for an improved apparatus of this nature which permits operating in such an environment.

SUMMARY OF THE INVENTION

The present invention provides such an apparatus. It provides such an apparatus which is completely electronic in nature and thus operates on low voltages which greatly reduce the danger of explosion.

In accordance with the present invention, the flow in the line to be controlled is monitored by a flow meter which develops an analog signal proportional to flow which is converted to a flow proportional frequency in a voltage to frequency converter. This frequency is provided as an input to a first counter which acts as an integrator to obtain the actual value of the total flow. The output of the voltage to frequency converter is also provided to another counter which can be set with a lead. A desired volume amount is set using digital switches and stored in storage means. The stored value is compared with the value in the first counter, in a first comparator and with the value in the second counter in a second comparator. Each of the comparators has an associate flip-flop which is set when a comparison is reached. The flip-flop outputs are used respectively to drive amplifiers which, in turn, drive means in the line where the volume is being regulated. In response to the counter which had a preset lead in it reaching the desired value the flow is cut back or throttled so that the final portion of the flow occurs slowly permitting a fine metering. When the first counter reaches the desired value, the second comparator responds through its associated flip-flop and amplifier to completely terminate the flow. Associated with the device is a segmented display which normally is set to read the actual value from the first counter but which, in response to a switch closure, will also show the preset value. Also included are means to manually start and stop flow and means to initiate presetting of a desired value and a lead value into the system.

By using fully electronic components the requirements of being able to use the equipment in spaces having an explosive hazard along with freedom from maintenance is achieved with the apparatus of the present invention. By means of certain interlocks operated by function keys, great operational safety is achieved. Unintentional changes in the setting means for setting in the desired value of volume during operation does not influence the function of the presetting equipment.

Brief Description of the Drawings

The single FIGURE is a block diagram of the system of the present invention.

Detailed Description of the Invention

The apparatus of the present invention is intended for operation with a system in which a volume of liquid is supplied through a line containing means for throttling the flow, e.g., a throttle valve or controlled pump, means for terminating the flow and a flow meter which develops a flow proportional electrical signal. These elements are not shown on the FIGURE, the FIGURE only showing the electronic apparatus of the present invention which cooperates with these elements to control the flow. The analog signal from the flow meter designated E is an input to a voltage to frequency converter 11 which develops at its output a signal *e* which is a pulse train having a frequency proportional to the flow rate. This signal is the input to a first counter 13 which will in effect integrate the flow signal and will have stored therein a current indication of the volume from the beginning of the process up until the present time. The output of the voltage frequency converter 11 is also fed to the second counter 15 which has associated therewith a setting device 17 which permits presetting it with a lead value. Also provided are a plurality of digital switches S2, S3, S4 and S5 which are used to set a desired value into a storage means 19. Associated with the digital switches will be conventional digital to binary or BCD converters so that the stored value will be in the same number system as the values in the counters 13 and 15. These counters can be either binary or BCD counters.

The output of counter 13 is an input to a comparator 23 having as its second input the output of the storage means 19, e.g., a storage register. Similarly, the output of counter 15 is an input to a comparator 24 also having the output of storage means 19 as an input. Comparators 23 and 24 will change their output state when the value in the counter becomes equal to the value stored in the storage means 19. These outputs are respective inputs to flip-flop 25 and 27. The output of flip-flop 25 is coupled through an amplifier 31 and the output of flip-flop 27 through an amplifier 32. The amplifier 31 is coupled to means to interrupt the flow in the line in which the volume is being metered. The output of the amplifier 32 operates means to throttle the flow in the line to reduce the flow rate to permit fine metering.

Also provided is a segmented output display 29 which may be a LED display and which in the present embodiment is preferably a liquid crystal display. The output of counter 13 is coupled through gating means 20 and a decoder 21 which decodes the binary or BCD data from the counter into a segment output for the display 29. The second input to the gating 20 is from the storage means 19. Essentially, the gating may consist of two sets of gates enabled respectively by the two lines from a function switch T4 called repeat. When in the normal position shown, the gates coupling the counter 13 to the decoder 21 are enabled and readout 29 gives an indication of the total volume which has passed through the line since the beginning. If it is desired to compare that value with the total volume requested and set into the storage means 19, the switch T4 can be moved to the other position to enable the gates in the gating 20 to couple the storage means 19 to the display.

Also provided are function switches T2 — a start switch and T3 — a stop switch. These are coupled to the set and reset inputs of the flip-flops 25 and 27 and permit manually setting and resetting the flip-flops thereby manually controlling their associated devices. Finally, there is a function switch T1 which is coupled to the storage means 19 and the counters 13 and 15 and is used for setting or initializing the apparatus.

A terminal Re1 is provided at the input to the storage means and a terminal Re2 at the output of the counter 13. This permits the apparatus of the present invention to also be employed in a process which is controlled by a digital computer. The terminal Re1 permits entering a desired value from the digital computer and the terminal Re2 permits reading out the actual value to the computer.

It is preferred that each of the function switches T1 – T4 be contactless type switches which, upon being operated, apply the voltage $U_v$ as required.

In operation, the desired amount of liquid, i.e. the desired value, is set in using the digital switches S2 – S5. At the same time the setting device 17, which will also be a digital switch, is set to the desired lead value. Typically, this value is approximately 0.5 to 1% of the desired value. Thereupon the switch T1 is closed. This causes the counter 13 to be set, the counter 15 to be preset with the value set into the setting device 17 and the storage means 19 to be preset with the value set in on the digital switches S2 – S5. After the switch T1 is momentarily closed to set in this value and then opened again, further changes in the switches 17 or S2 – S5 will have no effect on the system unless the switch T1 is again pressed. There is now stored in the storage means 19 a desired value and in the counter 15 a lead value. At this point, the switch T2 is depressed to set the flip-flops 25 and 27 and through their associated amplifiers 31, 32, to open a valve or a throttling device in the metering line, i.e., to fully open the line and establish a maximum flow rate. Flow begins and a measure of that flow is obtained as the signal E at the input to the voltage frequency coverter 11. It converts this analog signal to a frequency which is counted in the counters 13 and 15. Flow continues with the counters 13 an 15 incrementing until the counter 15 reaches the desired value. Since it had a lead in it it will reach this value before the counter 13. The comparator 24 responds resetting the flip-flop 27 and causing the throttling device to close down to restrict the flow and permit a fine metering of the last 0.5 to 1% of the desired value. The counter 13 continues counting but at a slower rate now and, when the desired value is reached therein, the comparator 23 responds to reset the flip-flop 25 which, in turn, causes a valve in the line to close immediately whereby the desired amount will have been metered.

At all times during operation, the actual volume which has been dispensed will be displayed on the display 29 unless the repeat switch T4 is pressed in which case, during the depression of that switch, the desired amount will be displayed. If at any time during the cycle, it becomes necessary to stop the metering, the switch T3 can be depressed to reset both flip-flops 25 and 27. After interrupting the process it is possible to restart it again by pressing the start switch T2. Since the switches have no effect on the counters or storage, the count will resume where it left off before and proper metering will occur.

What is claimed is:

1. Apparatus for metering a quantity of liquid through a line which contains therein a flow meter developing an output signal proportional to flow, means for reducing the flow in the line and means for terminating the flow therein comprising:

(a) a first counter having its input coupled to the output of the flow meter;

(b) means for storing a desired quantity to be metered;

(c) a first comparator having as inputs the outputs of said first counter and said means for storing;

(d) a second counter, said second counter also having as an input the output of the flow meter;

(e) means for presetting a lead value into said second counter;

(f) a second comparator having as inputs the output of said second counter and the output of said means for storing;

(g) a first flipflop having as an input the output of said first comparator, said flip-flop providing its output to control the means for terminating flow;

(h) a second flip-flop having as an input the output of said second comparator and providing its output; an to the means for reducing flow; and (i) display means having an input coupled to the output of said first counter.

2. Apparatus according to claim 1 wherein said means for storing comprises a storage register and a plurality of digital switches for presetting a desired value therein said means for presetting said second counter also comprises a digital switch and further including first switching means coupled to said first counter, said second counter and said storage register for resetting said first counter, presetting said second counter with the value set in said means for presetting and presetting said storage means with the value set on said plurality of digital switches.

3. Apparatus according to claim 1 and further including first and second switching means coupled respectively to the set and reset inputs of both said first and second flip flops for manually setting and resetting said flip flops.

4. Apparatus according to claim 1 and further including a terminal at the input of said storage means and a terminal at the output of said first counter both terminals adapted for coupling to a digital computer whereby a signal may be supplied to said first terminal to preset said storage means and the actual value in said first counter obtained from said second terminal.

5. Apparatus according to claim 1 wherein said display means is a segmented digital display and further including decoding means having inputs coupled to said counter and outputs coupled to said display.

6. Apparatus according to claim 5 and further including gating means interposed between said first counter and said decoder, said gating means also having and input from said storage means.

7. Apparatus according to claim 6 and further including first switching means adapted to normally enable said gating means to couple said first counter to said decoder but upon activation to cause the gating means to couple said storage means to said decoder.

* * * * *